United States Patent [19]

Fogarassy

[11] 3,932,207

[45] Jan. 13, 1976

[54] PROCESS FOR OBTAINING CELLULOSE FROM LIGNO-CELLULOSIC RAW MATERIALS

[75] Inventor: Andre Fogarassy, Paris, France

[73] Assignee: Societe de Promotion et d'Exploitation Industrielles de Procedes de Brevets S.A., Geneva, Switzerland

[22] Filed: Mar. 5, 1973

[21] Appl. No.: 337,858

[30] Foreign Application Priority Data

Mar. 6, 1972 Switzerland ..... 3233/72

[52] U.S. Cl. ..... 162/19; 162/75; 162/76; 162/77; 162/84; 162/90

[51] Int. Cl.[2] ..... D21C 3/20; D21C 3/26

[58] Field of Search ..... 162/70, 77, 76, 75, 72, 162/81, 83, 90, 86, 19, 84

[56] References Cited

UNITED STATES PATENTS

| | | | |
|---|---|---|---|
| 1,362,723 | 12/1920 | Marr | 162/72 |
| 1,790,838 | 2/1931 | Richter et al. | 162/75 X |
| 2,022,654 | 12/1935 | Dreyfus | 162/76 X |
| 2,068,151 | 1/1937 | Remler | 162/72 |
| 2,308,564 | 1/1943 | McKee | 162/76 X |
| 2,753,309 | 7/1956 | Figdor | 162/76 X |
| 3,338,943 | 8/1967 | Speier | 162/72 X |
| 3,448,002 | 6/1969 | Bryce et al. | 162/19 |

*Primary Examiner*—Robert L. Lindsay, Jr.
*Assistant Examiner*—Arthur L. Corbin
*Attorney, Agent, or Firm*—Hubbell, Cohen, & Stiefel

[57] ABSTRACT

Prior to cooking, fragments of raw ligno-cellulosic material are impregnated with a solution of a lignin-solubilizing reactant in an organic solvent which has a boiling point higher than the cooking temperature in order for the material to absorb an amount of solution containing at least the amount of reactant required for solubilizing the lignin, then the impregnated material is immersed in a liquid which is substantially non-miscible with the solvent of said solution, said liquid having a boiling point higher than the cooking temperature, and said liquid is maintained at the cooking temperature until the lignin has been substantially converted to a derivative which is soluble in water or a water-miscible organic solvent.

12 Claims, No Drawings

PROCESS FOR OBTAINING CELLULOSE FROM LIGNO-CELLULOSIC RAW MATERIALS

This invention is directed to a process for obtaining cellulose from ligno-cellulosic raw materials such as wood, bamboo, straw and bagasse. The invention concerns particularly a process for obtaining so-called "chemical pulp" cellulose, suitable for paper production, or for various chemical uses.

It is known that in the conventional processes for manufacturing cellulosic pulp by treating wood, alkali or alkaline earth metal salts, weak acids, such as hydrogen sulfide, sulfurous acid, in aqueous solution are used.

Those processes have several disadvantages, in particular the need to continue the cooking of the wood chips for several hours (6 to 12 hours) for the lignin attack to be complete.

In order to accelerate the delignification of the chips, it is necessary to operate at a temperature of about 150°–180°C, therefore under a pressure of several atmospheres.

Furthermore, it is customary to work with solutions which have a weak concentration of reactants, hence the necessity for using large volumes of water with respect to the wood, and thus considerable amounts of liquids must be distilled for recovering the reactants.

In fact, one ton of unbleached pulp involves the production of 10 $m^3$ of black liquor.

All this leads to complex and large sized equipment, which are therefore very expensive and also involves a high power consumption.

The very high investments of a modern paper pulp plant lead to the construction of enormous units in order to reduce the prime cost.

To be normally supplied, said units must be installed in the heart of very large forests, hence a real difficulty for the working of smaller forests remains, of which a large number exist, although they too are scattered geographically.

Finally, the conventional processes further present the disadvantage of emitting ill-smelling gases which are liable to pollute the environment within a radius which may be greater than 10 km.

The novel process according to this invention does away with these disadvantages and shows the following advantages:

A very low water consumption for solubilizing the lignin. This consumption is practically limited to the amount of water brought by the wood used, and thus to its moisture content.

No emanation of ill-smelling gases, and hence no atmospheric pollution.

No residual water, and hence no river or land pollution.

The possibility of treating all kinds of trees, i.e. both resinous and leafy.

Velocity of the reaction. Indeed, the cooking time may vary, according to the kinds of trees and the operating conditions or according to the quality of the pulp desired, from 15 to 60 minutes.

The carrying out of the cooking under atmospheric pressure, whence follows less expensive plants.

The possibility of recovering the lignin without concentrating the black liquor.

The amount of reactants to be used is greatly reduced with respect to the conventional processes.

The possibility of building profitable and smaller units requiring only low investments.

The process according to the invention, wherein the ligno-cellulosic raw material is cooked in contact with a solution of a reactant for converting lignin into a derivative which is soluble in water or in a water-miscible organic solvent; then the thus formed derivative is extracted in an aqueous medium and the cellulose is separated from the aqueous extract, is characterized in that the raw material, in the form of fragments, is impregnated with a solution of said reactant in a solvent, at least a part of which has a boiling point higher than the cooking temperature so that the material absorbs an amount of solution containing at least the amount of reactant necessary for solubilizing the lignin, then the impregnated material is immersed in a liquid which is substantially non-miscible with the solvent of said solution, said liquid having a boiling point higher than the cooking temperature, and said liquid is maintained at the cooking temperature until the lignin is substantially converted into said derivative which is soluble in water or in a water-miscible organic solvent.

DETAILED DESCRIPTION OF A PREFERRED EMBODIMENT OF THIS PROCESS:

A. Impregnation of the ligno-cellulosic raw material.

Wood is reduced to fragments, e.g. to chips. The chips are impregnated at atmospheric or under reduced pressure with a cold or warm mixture of water and an organic solvent whose boiling point is higher than the cooking temperature.

This mixture contains, in solution, a variable percentage of a lignin-solubilizing reactant, in particular alkali or alkaline earth metal salts, or organic or mineral acids.

The percentage of reactant in the impregnating solution depends on the absorption capacity of the wood chips, and on the percentage of lignin in the wood. Generally, the wood contains about 30% by weight of lignin. The solubilization of this amount of lignin requires, for instance, approximatively 6% by weight of caustic soda, or approximatively 6% of $SO_2$ in the form of bisulfite, based on the weight of wood. Knowing the absorption rate of the impregnating solution by the wood, it is easy to calculate the minimum concentration of the solubilizing reactant such that the impregnated wood contains at least the amount of reactant required for solubilizing the lignin.

B. Cooking of the impregnated chips.

This operation is carried out in a liquid:

1. Having a boiling point higher than the temperatures required for cooking the chips, particularly 160°–180°C, in order to avoid the evaporation of the liquid used as the cooking medium.

2. Wherein the reactant-containing solution with which the chips have been impregnated is neither soluble nor miscible, or at most sparingly soluble or miscible.

Such a liquid may be a paraffinic mineral oil, or any other organic solvent.

The cooking operation may be carried out:

in batches. In this case, the previously impregnated and drained chips are immersed in an oil bath, then the whole is heated gradually to the cooking temperature of 160°–180°C. This temperature is then maintained during the cooking time - continuously. In this case, the oil bath is first heated to 160°C; then the chips are progressively thrown into it. The latter remain in the oil at a temperature of 160°–180°C during the cooking time.

During the cooking time, which may vary from 15 to 60 minutes, it is observed that the chips soften and become a pulpy, homogenous, dark-coloured mass, whereas the oil remains absolutely clean and colourless.

As soon as the chips are converted into said pulpy mass, the latter is separated from the oil by filtration. Then this mass of warm pulp is thrown into hot water (80°to 90°C). It is then that the phenomenon of defibration takes place instantaneously.

In fact, a sudden dispersion is observed, followed by separation of the cellulose which appears in the form of curled fibers, whereas the liqnin, an encrusting material which has reacted with the reactant, dissolves in the water. Thus cellulosic fibers suspended in water coloured by the lignin, i.e. the black liquor, are obtained.

The reactants which can be used as de-lignifying agents can be alkali or alkaline earth metal salts, or acids or acid anhydrides, or esters, in free form or in the form of complexes.

The following, non limiting, list may be given:

sodium phenate
sodium stearate
sodium or ammonium bisulfite
sodium acetate
calcium or sodium bisulfite
sodium anilide or other alkali or alkaline-earth metal anilides.

Generally, sodium or ammonium salts of weak mineral acids.

To prepare the solvent containing the reactant intended for impregnating the chips, any organic solvent having a boiling point higher than the cooking temperature, and watermiscible, can be used, particularly:

mono-hydroxy alcohols
glycerols
glycols
mono- or poly-phenols
water-miscible ethers or esters.

Generally, these organic solvents are used admixed with water. However, in certain cases, the moisture contained in the ligno-cellulosic raw material may provide the amount of water desired, and then the organic solvents are used for preparing the impregnating solution without adding water.

The liquid of the cooking bath may be an aliphatic, paraffinic or cyclic organic compound, with the proviso that on the one hand its melting point be lower than 40°C, and its boiling point higher than the cooking temperture, and that on the other hand it be non-miscible or poorly miscible with the reactant solution used for impregnating the chips or other fragments of the ligno-cellulosic material.

C. Washing of the cellulose pulp.

The cellulose fibers are separated from the black liquor by simple filtration, they are then washed with warm water to remove all the reactants and the soluble lignin. The cellulosic fibers are then further washed with suitable solvents to remove the residual mineral oil used for the cooking bath, and then the cellulose undergoes the normal bleaching cycle which is effected with the conventional agents. D) Treatment of the residual water, on black liquor.

Since the amount of water necessary for dispersing said cellulose pulp after cooking is greatly reduced, said black liquor may be treated:

either by acidification which causes the precipitation of the lignin which can be separated by simple filtration. Said acid precipitation is all the more desirable since it provides substantially clear, neutral liquors.

Indeed, since the wood was previously impregnated with reactant and the latter remains in the wood during the cooking, the amount of said reactant can be determined sufficiently accurately for all of it to be bonded to the lignin, unlike the conventional processes wherein the black liquor contains a large excess of unreacted reactant. Therefore, the neutralization of the black liquor only requires a small acid consumption to cause the precipitation of the lignin;

or said recovery of lignin can be conducted with agents capable of causing the massing together or even agglomeration of the lignin. In particular, these agents are oxides and hydroxides of alkali or alkali earth metal salts or heavy metal salts, or neutral or acidic alkali metal complex salts which can act as clarifiers or absorbents. As examples of said agglomerating agents, the following may be mentioned:

quicklime
slaked lime
baryta
sodium silicate and as examples of clarifying agents:

bentonite
active charcoal
animal charcoal
talc
ion-exchange resins

When the agents are added to the black liquor in varying proportions, a massing together of the liqnin is obtained which permits the clarification of the black liquor by simple filtration, decantation or centrifugation.

The oil which has impregnated the cellulosic mass during the cooking automatically floats on the surface of the black liquor, which permits its recovery by simple drawing off. This oil, since it is hydrophobic, is nowise soiled.

According to a preferred embodiment, after cooking, the cellulose pulp impregnated with solubilized liqnin is separated from its cooking medium by simple filtration by means of any kind of commonly used industrial filter in the paper or chemical pulp industry, in particular:

gravity filtration over cloth
centrifugal-filter
Archimedes-screw-filter
press-filter When the cooking medium has been filtrated, it is returned to the cooking vessel since it is not soiled by the pulp impurities.

The dried filtered pulp will be subjected to a methodical washing operation to remove the impurities it contains. These impurities are of two kinds, viz.:

soluble or water-miscible
water-insoluble or non-miscible with water.

Therefore, in order to be able to remove the whole of these impurities, the pulp must be washed both with water and with a suitable solvent which is water soluble or miscible with water and with the non water-miscible and non water-soluble impurities.

This operation is generally carried out with heating and under stirring which promotes the defibration of the pulp.

Preferably the washing is performed counter-currently, i.e. the pulp moves forward in one direction, whereas the washing liquid moves in the opposite direction.

The washing operation can be carried out in two ways:

a. in two stages, i.e. successive washings, water/solvent or solvent/water.

For example, the pulp is first washed with acetone, which being water-miscible, permits at the same time the elimination of all the non water-miscible or non water-soluble impurities. Then this washing is followed by washing with water;

b. in one stage, that is simultaneously with an azeotropic water + solvent mixture.

For example, a mixture of equal portions of water and acetone is prepared in a tank. It is known that said mixture is an azeotrope which distils at 56°C, and that the condensate is a mixture composed of 88% acetone and 12% water.

After filtering, the pulp, while still warm (140°–150°C), is gradually thrown into the tank containing the acetone + water mixture where, as the result of stirring, it is defibered. The cellulosic pulp expels the solubilized lignin and the impurities, and is impregnated with the acetone-water mixture.

The amount of heat brought by the pulp is practically sufficient for inducing the continuous distillation of the azeotrope, so that it raises the temperature of the water-acetone mixture in the tank to 56°–60°C.

The thus defibered cellulosic pulp is taken up again by a mechanical device, for instance an Archimedes screw, and is slowly pushed into a gutter outside the liquid, whereas the vapors of the water-acetone mixture will be refluxed and condensed, and the mixture will be poured on the top of the gutter to bring about the counter-current washing of the pulp.

Thus, the pulp which was previously impregnated with the acetone-water mixture (equal parts) from the tank, having been washed counter-currently by the azeotropic mixture (acetone 88%, water 12%) will be entirely rid of all the impurities which are then drawn into the tank.

Therefore, when the pulp arrives at the top of the gutter, it will contain only azeotropic mixture.

Before leaving this gutter, the pulp is drained, then it falls into another tank containing only warm water. In the latter, the pulp is impregnated with water (at about 60°C), and the residual azeotropic mixture distils and returns to the first tank.

Consequently, and this is very important, the volume of the water-acetone mixture, and of this mixture only, which is in the first tank, remains constant, whereas the total volume in this same tank increases during the operation. Indeed, the pulp which arrives is loaded with impurities, both non-miscible and miscible with this mixture, but the abovedescribed washing removes them from the pulps and these impurities for this reason gradually increase the total volume of the liquid in the tank.

The thus washed pulp, as the case may be, and if it seems necessary, is subjected to a mechanical defibration and, after going through the classifier, will be subjected to bleaching, a conventional operation.

The liquid in the first tank, because of the continuous arrival of impurities, therefore increases in volume and will constitute two distinct phases:

one, the cooking medium which is non-miscible with water will be drawn off and returned to the cooking vessel;

the other phase is an acetone water mixture + the impregnating solution for the chips with the reactant and the solubilized liqnin. This second phase is consequently what is called the black liquor proper.

Assuming that in the tank containing the azeotropic mixture there are 1 cubic meter of water and 1 cubic meter of acetone. As mentioned, because of the recycling of the azeotropic condensate, the amount of water remains constant during the entire operation.

On the other hand, assuming that each cubic meter of pulp going through the tank brings to said liquid 1 ton of reactant solution retained after the impregnation of the chips. This chip impregnating liquor contains approximately 200 kg of solubilized lignin and 60 kg of reactant (for example: sodium anilide), which have been referred to as water-soluble impurities.

This same amount of pulp also brings non water-soluble impurities (e.g. oil which constituted the cooking medium) which are estimated at approximately 300 kg.

When 10 tons of pulp have gone through this washing tank, the balance of the liquid mixture therein is as follows:

| | |
|---|---|
| water | 1 cubic meter |
| glycol | 10 cubic meters |
| lignin | 2 tons |
| sodium anilide | 600 kilograms |
| cooking oil | 3 tons |
| acetone | 1 ton |

On evaporating the acetone, there will only remain in the tank one ton of water, less 12% because of the azeotrope formation.

The liquid remaining in the tank separates into two layers:

the oil which remains colourless and floats; it is then drawn off and returned to the cooking vessel to be reused as a cooking medium;

the black liquor, which is regenerated to recover on the one hand: the solvent free from lignin and possibly containing unused lignin-solubilizing reactants which are intended to impregnate chips for the subsequent operations; and on the other hand: lignin combined with the reactants which have reacted in the delignification.

The separation technique for the last two components is effected by agglomeration with baryta or bentonite.

A particularly efficient method consists in preparing an aqueous solution of cold-saturated baryta (an aqueous solution saturated with baryta at 20°C contains approximately 5% of barium hydroxide) in which an amount of bentonite sufficient for forming a liquid having a creamy consistency is incorporated.

When said mixture is left for 4 to 5 hours, the bentonite swells. Then the whole is drained to the consistency of a powdery and moist mixture.

Then a certain amount of said powdery and moist mass (bentonite impregnated with barium hydroxide) is added to the black liquor in the proportion of 1 to 3% based on the volume of black liquor considered and the whole is then stirred to ensure the dispersion of the amount incorporated.

It is then observed that the black liquor acquires a viscous consistency. Indeed, due to the sizing phenomenon, the lignin and delignification reactants are agglomerated (and not precipitated).

The whole of this liquid will be filtered on an industrial filter.

This black liquor, filtered and from which the lignin has been removed, is perfectly translucent.

This liquor, as it is, after readjusting the reactant concentration, is reused for impregnating the chips.

The lignin and the reactants constituting the residue on the filter are taken up two or three times with the minimal amount of azeotrope (acetone 88%, water 12%) and filtered to extract the residual solvent, and the amount of residual azeotrope therefrom will then be reintroduced into the first washing tank.

The lignin, the reactants and the bentonite, therefore then constitute a solid no longer containing any solvent, and which can be subjected to the subsequent treatments according to the result aimed at, i.e.:

either 1

To be burnt as a thermal energy source which further permits after combustion, the recovery of the non-combustible reactants which will be reused for the other operations, or 2

A chemical treatment to produce various chemical products, for instance furfural, oxalic acid and pyro- and protocatechuic acids, and also the recovery of residual reactants.

The following examples illustrate the invention:

In the examples, the percentages and parts are given by weight.

EXAMPEL 1

10 gm of spruce chips (moisture content: 6%) are impregnated with an aqueous solution containing:

20 parts of caustic soda
5 parts of aniline

The cooking is effected continuously, in vaseline oil at 160°–180°C for one hour.

After washing and defibration, 7.60 gm of unbleached dried pulp, which may be easily bleached, are obtained.

EXAMPLE 2

10 gm of pine chips are impregnated with a solution containing:

40 parts of water
20 parts of caustic soda
5 parts of aniline
55 parts of glycol The heating is effected in batches, in paraffin oil at 160°–180°C for 30 minutes.

After washing and defibration, 7.2 gm of dried unbleached, hardly coloured pulp are obtained.

EXAMPLE 3

10 gm of poplar chips are impregnated with a solution containing:

30 parts of sodium anilide
40 parts of water
60 parts of glycol

Cooking is effected continuously in butyl acetylricinoleate at 160°–180°C for 60 minutes.

After washing and defibration, 7.4 gm of dried, unbleached, easily bleached pulp are obtained.

EXAMPLE 4

10 gm of birch chips are impregnated with a solution containing:

30 parts of acetone-sodium bisulfite compound
40 parts of water
5 parts of aniline
55 parts of diethanolamine The cooking is effected continuously in n-butyl benzoate at 160°–180°C for 1 hour.

After washing and defibration, 7.8 gm of dried, unbleached, hardly coloured pulp are obtained.

Example 5

10 gm of beech chips are impregnated with a solution of:

10 parts of sodium phenate
10 parts of sodium benzoate
40 parts of water
10 parts of diethanolamine
50 parts of glycerine The cooking is effected continuously in diethylene glycol mono-laurate at 160°–180°C for 30 minutes.

After washing and defibration, 7 gm of unbleached, dried and easily bleached pulp are obtained.

EXAMPLE 6

10 gm of oak chips are impregnated with a solution containing:

20 parts of caustic soda pellets
5 parts of sodium stearate
40 parts of water
5 parts of aniline
55 parts of glycerine The cooking is effected continuously in propiophenone at 160°–180°C for 60 minutes.

After washing and defibration, 8 gm of unbleached, dried and hardly coloured pulp are obtained.

EXAMPLE 7

10 gm of spruce chips are impregnated with a solution containing:

30 parts of acetone-sodium bisulfite compound
40 parts of water
5 parts of aniline
55 parts of triethanolamine The cooking is effected in batches, in dibutyl ether, at 160°–180°C for 1 hour.

After washing and defibration, 7 gm of unbleached, dried and easily bleached pulp are obtained.

EXAMPLE 8

10 gm of spruce chips are impregnated with a solution containing:

20 parts of ammonium thiosulfate
5 parts of triethanolamine
40 parts of water
55 parts of dipropyleneglycol The cooking is effected in batches in paraffin oil at 160°–180°C for 60 minutes.

After washing and defibration, 6.8 gm of unbleached, dried and hardly coloured pulp are obtained.

EXAMPLE 9

10 gm of beech chips are impregnated with a solution containing:

20 parts of ammonium thiosulfate
5 parts of aniline
30 parts of water
65 parts of glycol The cooking is effected continuously in silicone oil at 160°–180°C for 60 minutes.

After washing and defibration, 7.2 gm of unbleached, dried easily bleached pulp are obtained.

EXAMPLE 10

10 gm of poplar chips are impregnated with a solution containing:

20 parts of sodium benzoate
5 parts of aniline
40 parts of water
55 parts of triethanolamine The cooking is effected continuously in silicone oil at 160°–180°C for 60 minutes.

After washing and defibration, 7 gm of unbleached, dried and hardly coloured pulp are obtained.

From the above, it can be seen that the process just described, provides the following advantages:

1. The preliminary treatment of the chips by impregnating them warm or cold, at atmospheric pressure or under reduced pressure, allows the reduction of the amount of reactants to the strict minimum required for the solubilization of the cellulose encrusting material.
2. Since the reactants in the chips are in solution in a mixture of water and organic solvent, they control and ensure the gradual increase of the temperature of the chips in the cooking bath.
3. Hence, the reactants' concentration increases as the water evaporates. But the chips do not reach the point of complete dehydration. Indeed, since the organic solvent is not miscible with the liquid in the cooking bath, it remains in the chips during the cooking and thus protects the cellulosic fiber against degradation which might be caused by the heat of the cooking bath.

The reaction between the encrusting materials, particularly lignin, and the reactants introduced into the chips by impregnation, is instantaneous and very complete.

When the moisture in the chips, introduced by impregnation thereof, is evaporated, the cooking liquid, in particular the oil, partly penetrates into the reaction mass and, thus lubricating the cellulose fibers, causes the disintegration of the chips by suppressing the agglomeration capacity of the encrusting materials.

Consequently, the liquid of the cooking bath, in particular the oil, takes on four roles in the cooking mechanism, viz.:

a. a homogenous heating of the chips
b. a lubrification of the fibers, which promotes the separation of the fibers, i.e. the defibration of the chips
c. a protection of the cellulose fiber against its possible degradation due to heating
d. the prevention of the polymerization of certain hemicelluloses occuring in the composition of the encrusting materials.

I claim:

1. In a process for obtaining cellulose from ligno-cellulosic raw materials comprising the steps of cooking the raw material in contact with a solution of a reactant for converting lignin present in said raw material into a derivative which is soluble in water or in a water-miscible organic solvent, extracting the thus formed derivative in an aqueous medium, and separating cellulose from the aqueous medium, the improvement which comprises impregnating the raw material, before the cooking step, in the form of fragments, with a solution of said reactant in a solvent which has a boiling point higher than the cooking temperature and which is selected from the group consisting of ethyleneglycol, dipropylengeglycol, glycerol, aniline, diethanolamine and triethanolamine and mixtures of at least one of these substances with water, said reactant being employed in an amount sufficient to solubilize the lignin, whereby the raw material absorbs a portion of the solution, after which the impregnated material is immersed in a liquid which is substantially non-miscible with the solvent of said solution, said liquid having a boiling point higher than the cooking temperature, and which is selected from the group consisting of paraffinic mineral oils; siloxanes, n-butyl acetylricinoleate, n-butyl benzoate, diethyleneglycol monolaurate, propiophenone, dibutylether and mixtures thereof and then maintaining said liquid having the impregnated material immersed therein at the cooking temperature until the lignin has been substantially converted to said derivative.

2. A process according to claim 1, wherein said solution is a solution of sodium hydroxide in a mixture of aniline and water, and said liquid is a paraffinic mineral oil.

3. A process according to claim 1, wherein said solution is a solution of sodium hydroxide in a mixture of ethyleneglycol, aniline and water, and said liquid is a paraffinic mineral oil.

4. A process according to claim 1, wherein said solution is a solution of sodium anilide in a mixture of ethyleneglycol and water, and said liquid is n-butyl acetylricinoleate.

5. A process according to claim 1, wherein said solution is a solution of the acetone-sodium bisulfite compound in a mixture of aniline, diethanolamine and water, and said liquid is n-butyl benzoate.

6. A process according to claim 1, wherein said solution is a solution of sodium phenate and sodium benzoate in a mixture of glycerol, diethanolamine and water, and said liquid is diethyleneglycol monolaurate.

7. A process according to claim 1, wherein said solution is a solution of sodium hydroxide and sodium stearate in a mixture of glycerol, aniline, and water, and said liquid is propiophenone.

8. A process according to claim 1, wherein said solution is a solution of the acetone-sodium bisulfite compound in a mixture of aniline, triethanolamine and water, and said liquid is dibutylether.

9. A process according to claim 1, wherein said solution is a solution of ammonium thiosulfate in a mixture of dipropyleneglycol, triethanolamine and water, and said liquid is a paraffinic mineral oil.

10. A process according to claim 1, wherein said solution is a solution of ammonium thiosulfate in a mixture of ethyleneglycol, aniline and water, and said liquid is a siloxane.

11. A process according to claim 1, wherein said solution is a solution of sodium benzoate in a mixture of triethanolamine, aniline and water, and said liquid is a siloxane.

12. A process according to claim 1, wherein, said aqueous medium is an azeotropic mixture having a low boiling point.

* * * * *

UNITED STATES PATENT OFFICE

CERTIFICATE OF CORRECTION

Patent No. 3,932,207 Dated January 13, 1976

Inventor(s) ANDRE FOGARASSY

It is certified that error appears in the above-identified patent and that said Letters Patent are hereby corrected as shown below:

Column 2, lines 42 and 43: "approximatively" should read -- approximately --.

Column 3, lines 67-68:
"with the conventional agents. D) Treatment of the residual water, on black liquor." should read
-- with the conventional agents.

D. Treatment of the residual water, on black liquor. --.

Column 4, lines 36 and 46: "liqnin" should read -- lignin --.

Column 5, line 61 : "abovedescribed" should read -- above-described --.

Column 10, line 11: "dipropylengeglycol," should read -- dipropyleneglycol, --.

Signed and Sealed this twentieth Day of April 1976

[SEAL]

Attest:

RUTH C. MASON
Attesting Officer

C. MARSHALL DANN
Commissioner of Patents and Trademarks